United States Patent [19]

Haynes

[11] Patent Number: 4,877,245

[45] Date of Patent: Oct. 31, 1989

[54] GAME APPARATUS

[76] Inventor: Kenneth A. Haynes, 55 Garden Walk, Royston, Hertfordshire, England, SG8 7JE

[21] Appl. No.: 132,096

[22] PCT Filed: Apr. 6, 1987

[86] PCT No.: PCT/GB87/00236

§ 371 Date: Nov. 30, 1987

§ 102(e) Date: Nov. 30, 1987

[87] PCT Pub. No.: WO87/05820

PCT Pub. Date: Oct. 8, 1987

[30] Foreign Application Priority Data

Apr. 4, 1986 [GB] United Kingdom ..... 8608284
Nov. 14, 1986 [GB] United Kingdom ..... 8627235

[51] Int. Cl.[4] ..... A63B 67/14
[52] U.S. Cl. ..... 273/110; 273/113
[58] Field of Search ..... 273/109, 110, 115, 340, 273/398, 401, 402

[56] References Cited

U.S. PATENT DOCUMENTS

| | | | |
|---|---|---|---|
| 1,595,071 | 8/1926 | Carlson | 273/110 |
| 2,092,162 | 5/1936 | Hiatt | 273/110 |
| 2,248,859 | 8/1941 | Ferreri | 273/110 |
| 3,985,360 | 10/1976 | Meyer | 273/110 |
| 4,089,526 | 5/1978 | Olving | 273/110 |
| 4,236,716 | 12/1980 | Douglas | 273/110 |
| 4,669,727 | 6/1987 | David | 273/110 |
| 4,746,121 | 5/1988 | David | 273/110 |

FOREIGN PATENT DOCUMENTS

| | | | |
|---|---|---|---|
| 0105617 | 4/1984 | European Pat. Off. | 273/110 |
| 819666 | 10/1937 | France | 273/110 |
| 2440209 | 7/1980 | France | 273/110 |
| 2063080 | 6/1981 | United Kingdom | 273/110 |

*Primary Examiner*—Edward M. Coven
*Assistant Examiner*—Gary Jackson
*Attorney, Agent, or Firm*—Young & Thompson

[57] ABSTRACT

A table or table-top game, which simulates the game of golf for example, comprises a base (44), a pair of rods (24) on which a ball (30) rests, and a support bar (48) which is capable of adjustment movement by being raised and lowered. Beneath the rods is a sheet of material (58) which can be printed to represent a golf course and which can be advanced from one roller (60) to another roller (62). A grid is placed over the sheet (58) to restrain the ball from movement after it drops from the rods. By moving the rods apart and together it is possible to cause the ball to travel towards the crosspiece (51) of the bar. The ends of the rods (24) remote from the crosspiece (51) can be mounted in any one of a plurality of different locating positions (28) so that the track defined by the rods can traverse different zones of the base (44).

22 Claims, 4 Drawing Sheets

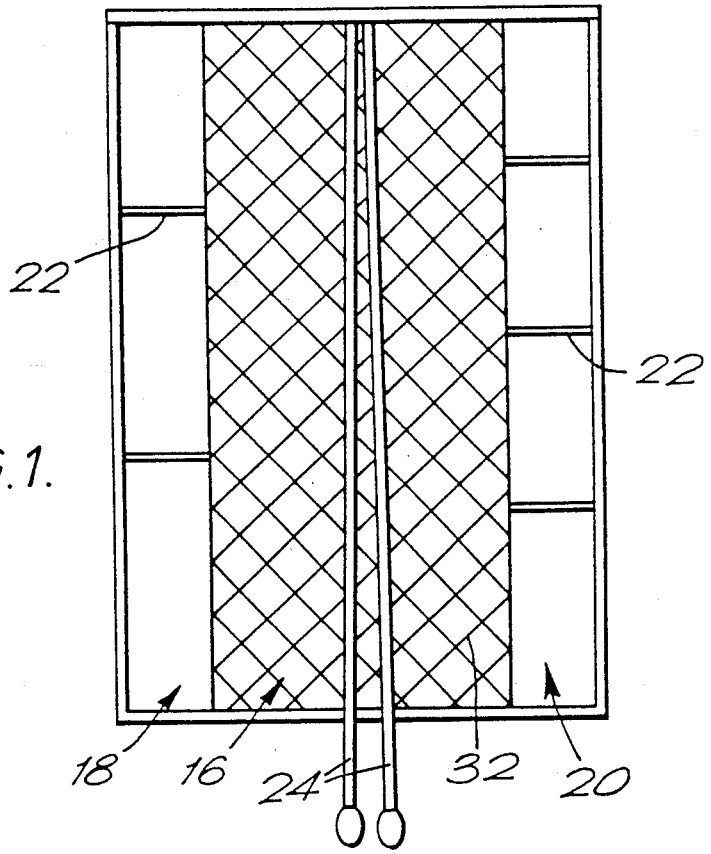
FIG. 1.
FIG. 2.
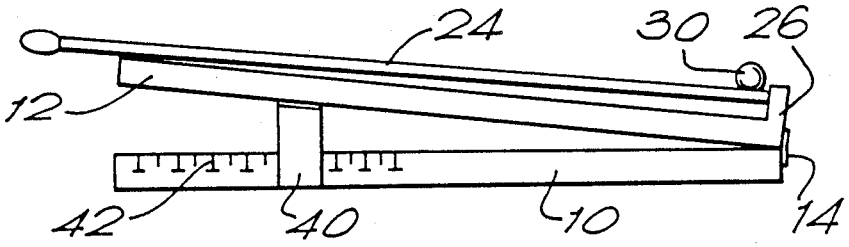
FIG. 3.
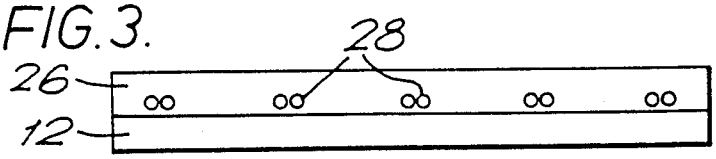

GAME APPARATUS

This invention relates to apparatus for playing a game, and is particularly concerned with a table or table-top game. The apparatus is especially appropriate for playing a table or table-top game which simulates the game of golf.

It is a particular object of the present invention to provide a game apparatus by means of which the players can play a game which is a realistic representation of the game of golf and which requires skill on the part of the players.

A game is already known in which a pair of rods are mounted in a frame so as to extend upwards at a shallow angle from their one end, where they are fixed, to their other end where they can be moved together and apart in a horizontal plane, and where a ball which normally rests at said one end of the rods is arranged, by manually moving the rods apart, to travel along the rods towards their said other end. The arrangement of the rods and ball is such that the ball in its movement appears to run "uphill". In this known game the frame within which the rods are mounted is provided with a base in which a number of recesses are formed to receive the ball when it drops down between the rods at the end of its movement. The skill in this game is to cause the ball to move as far as possible along the track defined by the rods without letting the ball fall through the gap between the rods. This has to be accomplished simply by movement of the rods towards and away from each other. In the known game, an increasing score is awarded as one is able to move the ball further and further along the track defined by the rods.

The present invention utilises the basic principle upon which this known game is based. However, the game apparatus of the present invention has a considerable number of features and advantages which are not provided by the known game and which individually and in combination enable the players to play a realistic "indoor" game, for example a game of golf.

In accordance with one aspect of the present invention there is provided a game apparatus comprising frame means, a pair of rods which define a track and which are mounted on or in the frame means so as to lie at a shallow upward angle to the horizontal from one end where they are mounted on or in the frame means to the other end where they are capable of relative movement, and a rolling element arranged to move along the track defined by the rods from said one end towards said other end upon relative movement of the rods, characterised in that the rods are capable of being mounted on or in the frame means at a plurality of locating positions whereby the track defined by the rods can traverse a plurality of different zones of the frame means below the rods.

In accordance with another aspect of the present invention there is provided a game apparatus comprising frame means, a pair of rods which define a track and which are mounted on or in the frame means so as to lie at a shallow upward angle to the horizontal from one end where they are mounted on or in the frame means to the other end where they are capable of relative movement, and a rolling element arranged to move along the track defined by the rods from one said end towards said other end upon relative movement of the rods, characterised in that the angle to the horizontal at which the rods lie is capable of adjustment to vary the angle relative to the horizontal of the track defined by the rods.

The frame means preferably comprises a base divided into a number of different zones commensurate with the different locating positions at which the rods can be mounted on or in the frame means.

In the application of the game apparatus to the game of golf the base preferably comprises a central zone which represents the fairway, with further zones being provided on each side of the central fairway, suitably divided lengthwise of the frame means to represent putting strokes, instructions, etc.

The central zone which represents the fairway, preferably incorporates a grid member on to which the ball is arranged to fall in order to determine the position of that "shot" on the fairway.

Because of the nature of a golf course, and because it takes a number of shots to travel from tee to green, the game apparatus of the present invention, in order to simulate the game of golf, is such that each player is required to play a number of "shots" in terms of the ball travelling along the track to drop on to the fairway grid. In order that the player should make progress from tee to green it is necessary for the representation of the fairway and/or green to change within the frame means from stroke to stroke. This can be achieved either by arranging for a representation of the hole to be reproduced on a roll which can be arranged to travel along the frame after each "shot" is played, or for the apparatus to include a number of chart sections which together represent a complete course and which can be inserted one after the other into the frame means before each shot is played.

In order for the game to be played effectively between players of differing skills or experience, it is desirable that the angle of inclination of the rods to the horizontal can easily be varied from shot to shot. This can be achieved for example by the use of sliding wedges displaceable along a fixed base member and by their movement causing a pivotable upper frame member to rise or fall.

Because with the present invention a ball is used as a component part of the game and the position of the ball is important to the proper playing of the game, it is important that the ball should be held against rolling movement, so that its position within the game can be noted.

In accordance with another aspect of the invention there is provided a restraining device for a ball used in an indoor table or table-top ball game, the device comprising a grid member having a plurality of upstanding protuberances spaced such that a ball dimensioned to fit between the protuberances when dropped on to the grid member will always fall between and be restrained by the protuberances and will be unable to remain resting upon the top of the protuberances.

In accordance with yet another aspect of the present invention, there is provided a restraining device as aforesaid which is transparent and which is used in conjunction with an underlying sheet carrying information relevant to the playing of the game. For example, the underlying sheet may be a representation, in whatever form, of a golf course.

According to one embodiment, the grid member is formed from a sheet of material which carries the protuberances, and, between groups of protuberances, holes are provided through the sheet of material so that an underlying sheet can be marked, through these holes, with the position of the ball.

The restraining device may be made by a vacuum forming technique, or, alternatively, be moulded from plastics material, for example a semi-rigid PVC material.

In order that the invention may be fully understood a number of embodiments in accordance with the invention will now be described by way of example and with reference to the accompanying drawings, in which:

FIG. 1 is a schematic plan view of a first embodiment of game apparatus in accordance with the invention;

FIG. 2 is a side view of the game apparatus of FIG. 1;

FIG. 3 is a front end view of the upper portion of the frame of the game apparatus of FIGS. 1 and 2;

Figure 4:
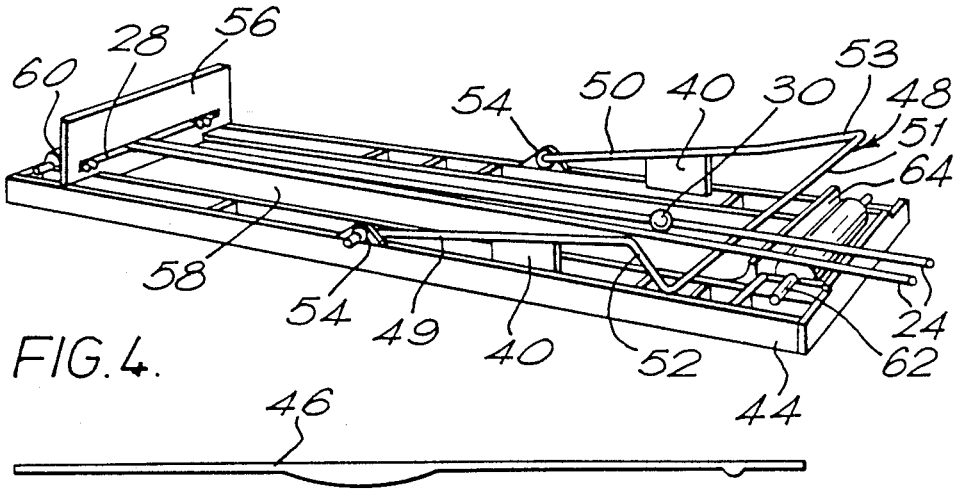
FIG. 4 is a perspective view of a preferred embodiment of game apparatus in accordance with the invention, with the grid not shown.

As shown in FIGS. 1 to 3, which illustrate a simple version of the apparatus, the apparatus comprises a frame made up of a base portion 10 and an upper portion 12. In the embodiment shown in FIGS. 1 to 3, the upper portion 12 is connected to the base portion 10 by a hinge 14 so that the angle of tilt of the upper portion 12 can be varied. The upper portion 12 of the frame comprises an open rectangular frame, whereas the base portion 10, as shown most clearly in FIG. 1, is provided with a special lay-out. The base portion 10 of the frame is divided into a number of zones extending lengthwise of the frame. In FIG. 1 three such zones are illustrated. When the game apparatus is designed to simulate the game of golf the central zone indicated generally at 16 represents the golf fairway, and the two lateral zones indicated generally at 18 and 20 are each divided into a number of "pockets" by transverse walls 22.

A pair of rigid rods 24, for example steel rods, have their one end fitted removably in holes, slots, open or closed grooves, etc., within an upstanding rear end portion 26 of the upper frame portion 12. As shown in FIG. 3, a plurality of locating positions, e.g. holes 28, are provided in the upstanding frame portion 26 for the ends of the rods 24 to be mounted therein or thereon. Any convenient method of locating the ends of the rods 24 may be used. For example, in one alternative, a single elongate slot can be provided across the width of the frame, with a series of semi-circular recesses formed in the slot at intervals to locate the ends of the rods 24 at predetermined positions. Appropriate friction means, such as a rubber ring, can be fitted to the ends of the rods to assist in the location of the rod ends in the frame. In the embodiment shown in FIGS. 1 to 3, there are five separate locating positions provided for the rods 24 across the width of the frame, but this number can be greater or smaller, as desired.

The ends of the rods 24 remote from the locating ends project beyond the front end of the frame 10, 12 and these projecting ends are designed to be gripped manually by the players. A ball 30 is positioned on and between the rods 24, as shown in FIG. 2, when the game is to be played. If the rods 24 are moved apart, thereby widening the track for the ball, the ball will move forwards along the rods towards the player. Eventually, the ball will drop between the rods on to the base of the frame. The skill element in the game is to move the rods 24 apart and together in such a way as to cause the ball 30 to travel as far as possible from its rest position towards the player before it drops down between the rods.

Figure 5:
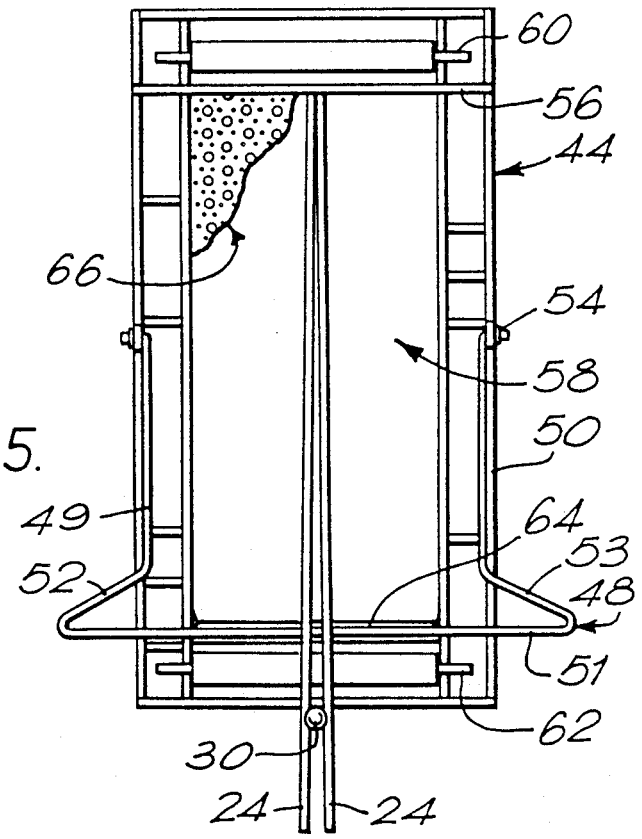
FIG. 5 is a plan view of the apparatus of FIG. 4 with the grid in place.

The central zone 16 of the base is provided with means to locate the ball 30 in place when it drops down between the rods. This locating means can conveniently comprise a grid 32 which has upstanding portions defining the grid boundaries, so that the ball 30 will drop into one of the grid pockets and be prevented from rolling. In FIG. 1 this grid is represented as a simple squared grid. Other, preferred forms of grid will be described hereinafter. In adaptation of the apparatus to the game of golf, there is provided below the grid 32 a representation of at least part of a golf course. This representation of a golf course can either consist of a plurality of removable sheets which can be slid under the grid and each of which represents part of the fairway, or else one can provide a continuous roll which can be moved lengthwise of the frame to represent movement along the fairway as one proceeds from tee to green. Such an arrangement is shown in FIGS. 4 and 5 and will be described hereinafter.

Whether the apparatus is provided with a series of charts or with a continuous roll, the surface beneath the grid 32 is designed to represent the layout of a golf course. One can either represent the actual holes of an existing course or design a course of one's own with fairway, bunkers, hazards, rough, etc.

The lateral zones 18 and 20 of the frame are divided into individual smaller zones. For example, zone 18 can be divided to represent different hazards, and zone 20 can be divided up to represent the number of putts taken when the player has reached the green. By providing that the rods 24 can be moved to different locating positions across the width of the frame one is enabled to play shots down the central fairway or play shots down the side zones. By providing a number of locating positions across the width of the central zone 16 itself, one can arrange for individual "holes" to be played as a dog-leg hole.

As shown in FIG. 2, the frame is hinged so that the angle of inclination of the rods 24 to the horizontal can be varied. For example, a pair of sliding wedges 40 can be provided, one on each side of the frame, which raise the upper frame portion 12 as the wedges are pushed towards the hinged end of the frame. The base portion 10 of the frame can be provided with markings 42 which represent a player's handicap. By this means two or more players of different skill or different experience can play against each other simply by varying the angle of slope of the frame according to the player's "handicap". The more the upper frame portion is raised, the more difficult it is for the ball to travel towards the front end of the frame.

In an alternative embodiment of the invention, the frame is a static frame without a hinged portion, and the rods 24 are then always positioned at the same angle of inclination to the horizontal. In this version one can then adopt some other system of handicapping, for example by the use of cards or by players giving each other strokes at particular holes, as in a conventional game of golf.

It should also be understood that although in the illustrated embodiment of the game the frame is provided with three zones 16, 18 and 20, one could provide more zones, or even just one zone, within the scope of the present invention.

Referring now to FIGS. 4 and 5, these show a preferred embodiment of game apparatus. Here, the apparatus comprises a base 44 which may be made for example of plastics material by a vacuum forming process. Alternatively, the base 44 may be made of wood. In the case of a wooden base 44 one can provide an under-base as indicated at 46, which incorporates a turntable and feet. In this embodiment the upper frame 12 of FIG. 1 and 2 is replaced by a simple bar 48, which is preferably of metal. This bar 48 has two side arms 49 and 50 which are connected to a crosspiece 51 by outturned portions 52 and 53. The free ends of the side arms 49, 50 are received in housings 54 formed as part of the side walls of the base, and are secured therein by grommets or the like. These free ends of the side arms 49, 50 must be housed in such a way that the side arms are capable of upward and downward pivoting movements. As is shown in FIG. 5, the two rods 24 rest upon the crosspiece 51 of the bar 48 in play. The joined ends of the rods 24, remote from the player, are held in holes, slots, grooves or the like 28 in a transverse upstand 56 towards the end of the base remote from the player. The holes, grooves, slots or the like 28 can either be provided within the upstand 56 itself, or alternatively on or in a transverse member fitted immediately in front of the upstand.

In order to vary the degree of difficulty, the bar 48 rests upon two sliding wedges 40 which are preferably formed as blocks, grooved top and bottom, so that they sit on the side walls of the base and have the side arms 49, 50 of the bar resting in the grooves in their upper surfaces.

In this embodiment there is provided a continuous roll of material 58 which defines the playing surface. In an apparatus designed to simulate the game of golf, this roll 58 will represent the fairway. The roll is preferably a roll of PVC material, printed, for example by a silk screen process, with a realistic representation of a playing area or areas. In the case of golf the roll would be printed with a sequence of for example 9 or 18 holes, thus representing a complete golf course. By the use of a silk screen printing process one can achieve extremely realistic representations of a golf course for example, including all the usual hazards, such as water, bunkers, trees, etc. Rollers 60 and 62 are provided one at each end of the base 44 to mount the fairway roll 58, so that the fairway roll 58 can be rolled from one end to the other as the game progresses. The fairway roll 58 passes beneath the upstand 56 at one end of the base and beneath an equivalent upstand 64 adjacent to the players' end of the base.

As in the embodiment shown in FIG. 1, the base 44 is here again divided into three zones. The central zone carries the fairway roll 58, whereas the two side zones are divided into a plurality of "pockets". In a simulated golf game, these side pockets represent different "instructions" to the player, depending upon the pocket into which his ball drops. For example, as shown in FIG. 5, the left hand side zone of the base comprises five pockets which represent the number of putts which the player is deemed to have taken. The right hand side zone of the base is divided into five further pockets. These right hand pockets are used if a player drops the ball 30 into a "hazard" on the fairway in the course of play. These right hand pockets can be used in conjunction with separate cards or dice in order to give instructions to the player as to how to move from the hazard.

Clearly, it is important to the proper functioning of the apparatus of the present invention that the ball 30 when dropped from the rods 24 should be retained in place on the underlying surface. Additionally, it is desirable that when the ball drops on to the playing surface as represented by the PVC roll 58, it should be evident to the player whether his ball has landed in a hazard area or not. In other words, the "dropping zones" should desirably be matched up with the underlying simulated playing surface on the roll 58. In order to retain the ball in place on the playing surface, this preferred embodiment of the invention uses a clear grid 66 which is only partially shown in FIG. 5. Various embodiments of grid 66 suitable for use with the apparatus of FIGS. 4 and 5 will now be described. The grid 66 is a rectangular element dimensioned to fit within the central zone of the base, above the printed roll 58.

Figure 6:
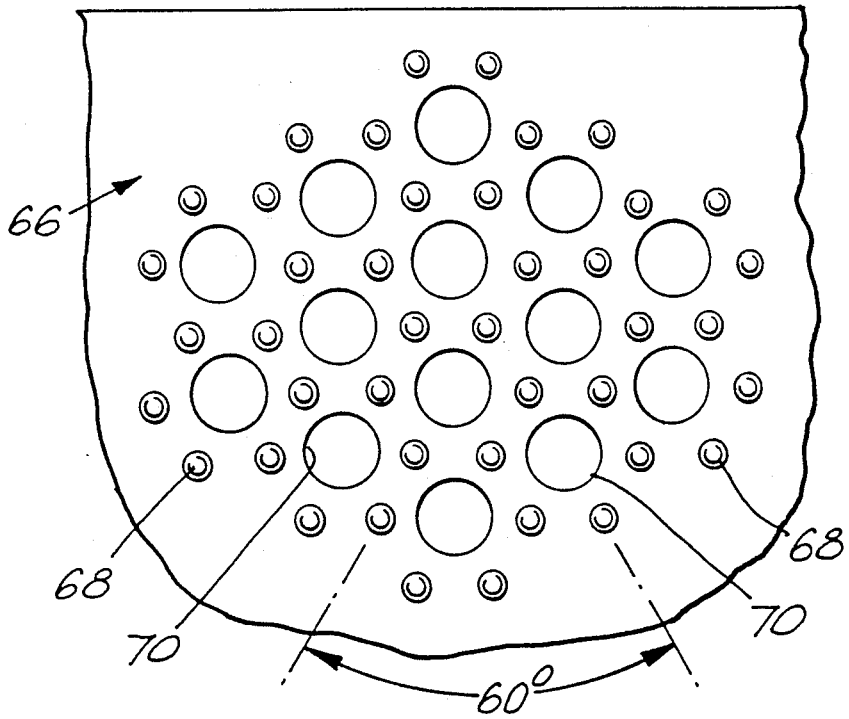
FIG. 6 is a plan view of a portion of a first embodiment of grid.
Figure 7:
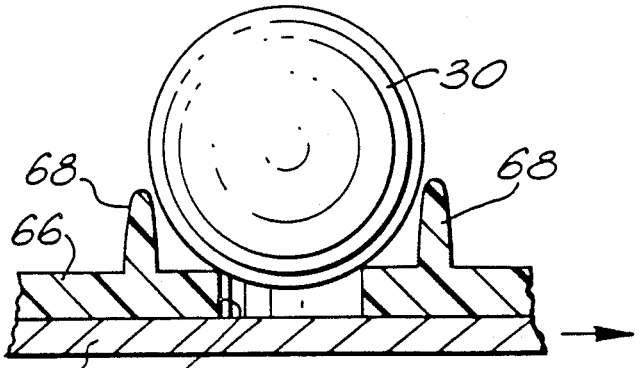
FIG. 7 illustrates a ball resting upon the grid of FIG. 6.

Referring first to FIGS. 6 and 7, there is shown a sheet 66 of semi-rigid clear plastics material, for example a PVC sheet, having a thickness of for example 1.5 to 2mm. Spaced on the sheet 66 are a plurality of upstanding projections 68 in the form of small spikes. As shown in FIG. 6, these projections 68 are arranged in groups of six, with the individual projections being positioned at the corners of imaginary hexagons. However, the individual groups of six projections are offset so that although they do have axes of symmetry they are not aligned regularly in straight rows. This configuration is adopted so that the ball 30 when dropped upon the grid will always fall between a group of six projections and cannot come to rest upon the top of the projections. As shown in FIG. 6, the array of projections is based upon an angular offset of 60°.

Centrally within each set of six projections 68 there is provided a circular hole 70 through the sheet material. Preferably, the ball, when resting within a group of six projections, has its bottom surface lying within the depth of the sheet 66 and not actually projecting below the bottom of the sheet 66. In this way the ball does not actually come into contact with the underlying roll 58 of material positioned below the plastics sheet 66. The provision of the holes 70 is so that players can mark the position of the ball, through the hole, on the underlying sheet 58. This avoids the need to have a separate scoring or recording device.

The individual projections 68 are preferably tapered, as shown most clearly in FIG. 7. Alternatively, these projections may be bell-shaped. This latter shape is preferred if the grid is manufactured as a vacuum formed sheet, instead of as a flat sheet with upstanding projections. It is simply necessary that the projections should restrain the ball 30 from rolling and should locate it between one of the sets of projections.

The underlying sheet 58 is arranged to be movable relative to the grid so that a progressive game can be played, with the players making markings on the underlying sheet 58 as the ball is dropped on to the grid by the players in turn.

Figure 8:
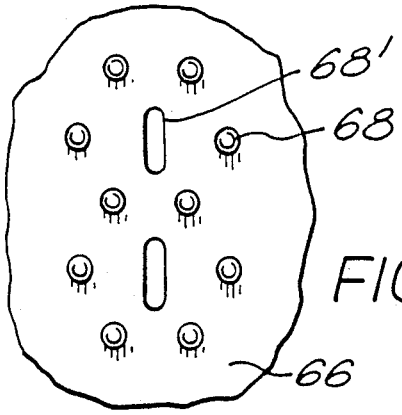
FIG. 8 shows an alternative shape of hole in the grid.

FIG. 8 shows an alternative shape for the holes 70 in the sheet 66. Here, the holes are in the form of slots 68'. Other shapes of hole may alternatively be used.

Figure 9:
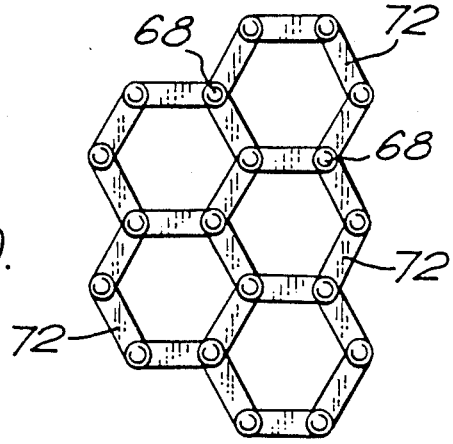
FIG. 9 is a plan view of a portion of a second embodiment of grid.

FIG. 9 shows a second configuration of grid. Instead of having projections 68 standing up from a base sheet as in FIG. 6, the projections 68 are here upstanding from a network of bridging pieces 72. The bridging pieces 72 connect the individual projections, leaving hexagonal holes between the projections into which the ball will fall. This embodiment can be formed readily by an injection moulding process, and avoids the need for the cutting of holes 70 in a base sheet as is necessary with the grid shown in FIG. 6.

Figure 10:
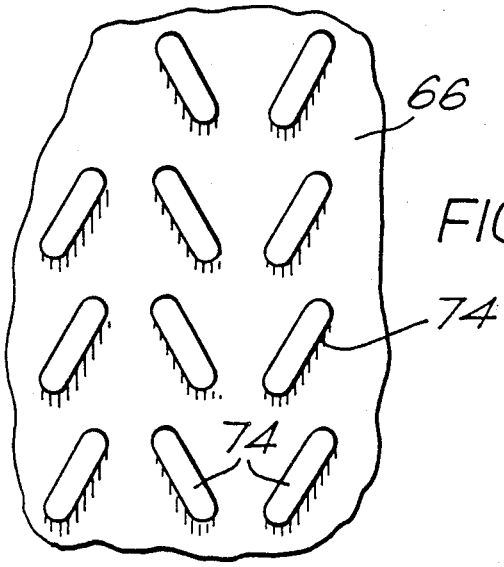
FIG. 10 is a plan view of a portion of a further embodiment of grid.

In yet another arrangement, as shown in FIG. 10, the upstanding pins of FIGS. 6 to 8 are replaced by bars 74, using three bars 74 to replace every six pins, with the bars spaced around the edge of an imaginary hexagon. The bars 74 need only be deep enough to capture the ball as it drops o to the grid.

It should be appreciated that the arrangement of projections shown in the drawing, which is based upon a hexagonal array, can be replaced by alternative arrays of projections, provided that the array is such that the ball will always drop into a set of projections and will not remain suspended on top of them. Also, the actual shape and size of the projections will be dictated by manufacturing needs and by the dimension of the ball with which the grid is to be used. Furthermore, although the grid member is particularly well suited for use with a golf game where it can be laid over the representation of a golf course, the grid member can also be used for games based upon other sports where one wishes to denote positions within a playing area. One of the main advantages of the grid member of the present invention is that not only does it always locate the ball accurately without dispute, but one can also quickly and easily mark the position of the ball on the playing surface without the need for additional recording or marking devices separate from the playing surface itself.

Although the apparatus of the present invention is particularly well suited to represent the game of golf, other games and sports could also be adapted so as to be represented by the game apparatus of the present invention.

Although reference has been made above to the use of a grid to prevent the ball from rolling when it drops from the rods, one could alternatively use a cushioning material spread over the base, on to which the ball would drop and be retained without rolling.

I claim:

1. A game apparatus comprising frame means, a pair of rods which define a track and which are mounted on or in the frame means so as to line at a shallow upward angle to the horizontal from one end where they are mounted on or in the frame means to the other end where they are capable of relative movement, and a rolling element arranged to move along the track defined by the rods from said one end towards said other end upon relative movement of the rods, the angle to the horizontal at which the rods lie being capable of adjustment to vary the angle relative to the horizontal of the track defined by the rods, and a grid member of clear plastics material arranged to be received by the frame means and which when the rolling element is dropped thereon restrains the rolling element from rolling movement.

2. A game apparatus comprising frame means, a pair of rods which define a track and which are mounted on or in the frame means so as to lie at a shallow upward angle to the horizontal from one end where they are mounted on or in the frame means to the other end where they are capable of relative movement, a rolling element arranged to move along the track defined by the rods from said one end towards said other end upon relative movement of the rods, the angle to the horizontal at which the rods lie being capable of adjustment to vary the angle relative to the horizontal of the track defined by the rods, and a grid member comprising a plurality of projections upstanding from a network of bridging pieces which is arranged to be received by the frame means and which when the rolling element is dropped thereon restrains the rolling element from rolling movement.

3. A game apparatus comprising frame means, a pair of rods which define a track and which are mounted on or in the frame means so as to lie at a shallow upward angle to the horizontal from one end where they are mounted on or in the frame means to the other end where they are capable of relative movement, a rolling element arranged to move along the track defined by the rods from said one end towards said other end upon relative movement of the rods, wherein the rods are capable of being mounted on or in the frame means at a plurality of locating positions whereby the track defined by the rods can traverse a plurality of different zones of the frame means below the rods, and a grid member comprising a plurality of projections upstanding from a network of bridging pieces which is arranged to be received by the frame means and which when the rolling element is dropped thereon restrains the rolling element from rolling movement.

4. A game apparatus comprising frame means, a pair of rods which define a track and which are mounted on or in the frame means so as to lie at a shallow upward angle to the horizontal from one end where they are mounted on or in the frame means to the other end where they are capable of relative movement, a rolling element arranged to move along the track defined by the rods from said on end towards said other end upon relative movement of the rods, wherein the rods are capable of being mounted on or in the frame means at a plurality of locating positions whereby the track defined by the rods can traverse a plurality of different zones of the frame means below the rods, and a grid member of clear plastics material arranged to be received by the frame means which when the rolling element is dropped thereon restrains the rolling element from rolling movement.

5. Apparatus according to claim 4, in which the grid member is open to an underlying sheet so that markings can be made on the sheet through the grid member.

6. A game apparatus comprising frame means, a pair of rods which define a track and which are mounted on or in the frame means so as to lie at a shallow upward angle to the horizontal from one end where they are mounted on or in the frame means to the other end where they are capable of relative movement, a rolling element arranged to move along the track defined by the rods from said one end towards said other end upon relative movement of the rods, wherein the rods are capable of being mounted on or in the frame means at a plurality of locating positions whereby the track defined by the rods can traverse a plurality of different zones of the frame means below the rods, and wherein the frame means is provided with sheet means comprising a roll of material arranged to be displaceable lengthwise of the frame means as desired and in appearance simulating a game playing area onto which the rolling element is dropped.

7. Apparatus according to claim 6, in which the frame means comprises a base on to which a ball is arranged to drop, and which includes support means for the rods adjacent to said other ends of the rods.

8. Apparatus according to claim 7, in which the support means comprises a top frame set above a bottom frame which constitutes the base.

9. Apparatus according to claim 7, which includes wedge means slidable relative to the base to vary the level of the support means at said other end.

10. Apparatus according to claim 7, in which the support means comprises supporting bar means extending transversely of the base and upon which the rods are arranged to rest.

11. Apparatus according to claim 10, in which the support means is capable of being raised and lowered relative to the base.

12. Apparatus according to claim 11, in which the support means is pivotable relative to the base.

13. A game apparatus comprising frame means, a pair of rods which define a track and which are mounted on or in the frame means so as to lie at a shallow upward angle to the horizontal from one end where they are mounted on or in the frame means to the other end where they are capable of relative movement, a rolling element arranged to move along the track defined by the rods from said one end towards said other end upon relative movement of the rods, wherein the angle to the horizontal at which the rods lie is capable of adjustment to vary the angle relative to the horizontal of the track defined by the rods, and wherein the frame means is provided with sheet means which comprises a roll of material arranged to be displaceable lengthwise of the frame means as desired and which is appearance simulates a game playing area onto which the rolling element is dropped.

14. Apparatus according to claim 13, in which said rods at said one end are held together and are seated in means providing at least one recess adjacent to one end of the base.

15. Apparatus according to claim 13, in which the base comprises a central zone extending generally parallel to the rods and one or more lateral zones also extending generally parallel to the rods, the lateral zone or zones being divided transversely into individual receiving pockets.

16. Apparatus according to claim 13, in which the sheet means in appearance simulates a golf course.

17. A game apparatus comprising frame means, a pair of rods which defined a track and which are mounted on or in the frame means so as to lie at a shallow upward angle to the horizontal from one end where they are mounted on or in the frame means to the other end where they are capable of relative movement, a rolling element arranged to move along the track defined by the rods from said one end towards said other end upon relative movement of the rods, the angle to the horizontal at which the rods lie being capable of adjustment to vary the angle relative to the horizontal of the track defined by the rods, a grid member arranged to be received by the frame means and which when the rolling element is dropped thereon restrains the rolling element from rolling movement, said grid member having a plurality of upstanding protuberances spaced such that a rolling element dimension to fit between the protuberances when dropped on to the grid member will fall between and be restrained by the protuberances and will be unable to remain resting on top of the protuberances.

18. Apparatus according to claim 17, in which the protuberances are arranged in a hexagonal configuration.

19. Apparatus according to claim 17, in which the protuberances are tapered projections.

20. Apparatus according to claim 17, in which the grid member is open to an underlying sheet so that markings can be made on the sheet through the grid member.

21. Apparatus according to claim 17, in which the protuberances are arranged in a hexagonal configuration.

22. Apparatus according to claim 17, in which the protuberances are tapered projections.

* * * * *